US007664449B2

(12) United States Patent
Kimura

(10) Patent No.: US 7,664,449 B2
(45) Date of Patent: Feb. 16, 2010

(54) FIXING APPARATUS AND IMAGE FORMING APPARATUS

(75) Inventor: Taku Kimura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/806,619

(22) Filed: Jun. 1, 2007

(65) Prior Publication Data

US 2007/0280757 A1 Dec. 6, 2007

(30) Foreign Application Priority Data

Jun. 2, 2006 (JP) ..... 2006-154823

(51) Int. Cl.
*G03G 15/20* (2006.01)

(52) U.S. Cl. ..... 399/329; 399/328; 399/330

(58) Field of Classification Search ..... 399/328, 399/329, 330

See application file for complete search history.

(56) References Cited

U.S. PATENT DOCUMENTS

| | | | | |
|---|---|---|---|---|
| 5,832,353 | A * | 11/1998 | Sano | 399/329 |
| 5,907,348 | A * | 5/1999 | Ogasawara et al. | 399/329 |
| 5,950,060 | A * | 9/1999 | Isogai | 399/324 |
| 2003/0103789 | A1* | 6/2003 | Boss | 399/330 |
| 2004/0120739 | A1* | 6/2004 | Chen et al. | 399/329 |
| 2005/0100373 | A1* | 5/2005 | Kishino et al. | 399/329 |
| 2006/0165449 | A1* | 7/2006 | Ito et al. | 399/329 |

FOREIGN PATENT DOCUMENTS

| | | |
|---|---|---|
| JP | 04-044075 | 2/1992 |
| JP | 10-213982 | 8/1998 |
| JP | 2002-190369 | 7/2002 |
| JP | 2002-311735 | 10/2002 |
| JP | 2004-21081 | 1/2004 |
| JP | 2004-55395 | 2/2004 |
| JP | 2005-181838 | 7/2005 |

* cited by examiner

*Primary Examiner*—David M Gray
*Assistant Examiner*—Ryan D Walsh
(74) *Attorney, Agent, or Firm*—Rabin & Berdo, PC

(57) ABSTRACT

A fixing apparatus includes an endless belt, a fixing roller, a pressure roller, a sheet heating element, and a support. The fixing roller and support are positioned on the inside of the endless belt. The endless belt is entrained about the fixing roller and the support. The support supports the sheet heating element. The pressure roller is positioned on the outside of the endless belt. The pressure roller cooperates with the fixing roller to hold the endless belt between the fixing roller and the pressure roller in sandwiched relation such that a nip is formed between the endless belt and the pressure roller. The sheet heating element is in contact with the inside of the endless belt and heats the endless belt. The sheet heating element is disposed in an area outside of the nip.

12 Claims, 5 Drawing Sheets

FIXING APPARATUS AND IMAGE FORMING APPARATUS

BACKGROUND OF THE INVENTION

1. Field of the Invention

The present invention relates to a fixing apparatus and an image forming apparatus that incorporates the fixing apparatus.

2. Description of the Related Art

Conventional monochrome or color image forming apparatuses include copying machines, printers, and facsimile machines. These apparatuses use a fixing apparatus. One of conventional fixing apparatuses is configured such that a fixing belt is held between a heater and a pressure roller in sandwiched relation.

This type of fixing apparatus is advantageous in that the overall heat capacity of the fixing apparatus is relatively small, and therefore a fixing temperature may be reached in a very short time after power up of the apparatus, and in that power consumption is low. However, the conventional fixing apparatus is disadvantageous in that the temperature drop is significant when toner is fused into a recording medium and therefore temperature control is poor.

SUMMARY OF THE INVENTION

An Object of the invention is to provide a fixing apparatus that provides reliable temperature control.

A fixing apparatus includes an endless belt, a first pressure member, a second pressure member, and a sheet heating element. The first pressure member is positioned on the inside of an endless belt. The second pressure member is positioned on an outside of the endless belt, the second pressure member cooperating with the first pressure member to hold the endless belt between the first pressure member and the second pressure member in sandwiched relation such that a nip is formed between the endless belt and the second pressure member. The sheet heating element is in contact with the endless belt, the sheet heating element being disposed in an area outside of the nip and heating the endless belt.

The sheet heating element is disposed on the inside of the endless belt. The endless belt is entrained about the first pressure member and the sheet heating element.

The endless belt includes a resilient layer.

The first pressure member is a roller including a resilient layer.

The resilient layer is formed of a foamed resilient material.

The fixing apparatus further includes a supporting member disposed on the inside of the endless belt. The supporting member supports the sheet heating element and includes a surface that cooperates with the first pressure member endless belt such that the endless belt is entrained about the first pressure member and the supporting member and slides on the surface.

The second pressure member is a roller including a resilient layer.

The resilient layer is formed of a foamed resilient material.

The fixing apparatus further includes a temperature sensor that detects a temperature of the endless belt, the temperature sensor being located downstream of the nip with respect to rotation of the fixing belt and upstream of the heater with respect to rotation of the fixing belt.

The fixing apparatus further includes a release agent applying member is disposed such that the endless belt is sandwiched between the sheet heating element and the release agent applying member, the release agent applying member applying a release agent to the endless belt for facilitating smooth removal of a recording medium from the endless belt after fixing.

The release agent applying member includes a roller that applies the release agent to the endless belt, the roller contacting the endless belt under pressure.

The sheet heating element is a stainless steel heater.

An image forming apparatus incorporates the aforementioned fixing apparatus. The image forming apparatus includes an image forming section that forms a toner image and a transfer section that transfers the toner image onto a recording medium.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limiting the present invention, and wherein.

DETAILED DESCRIPTION OF THE INVENTION

The invention will be described in detail with reference to the accompanying drawings.

First Embodiment

Figure 1A:
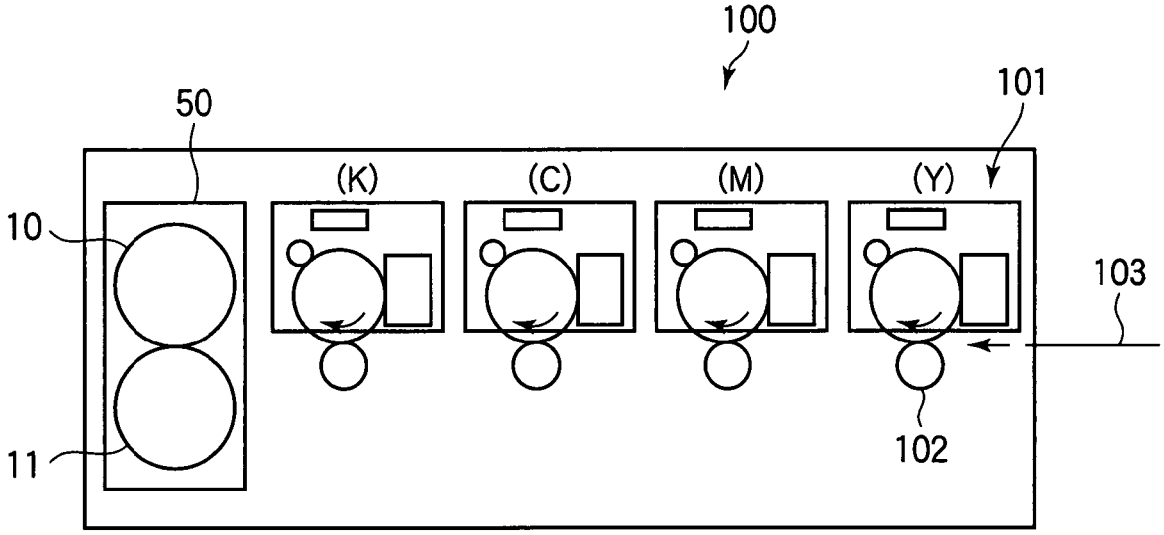
FIG. 1A illustrates a general configuration of an image forming apparatus equipped with a fixing apparatus according to the invention.

FIG. 1A illustrates a general configuration of an image forming apparatus 100 equipped with a fixing apparatus according to the invention.

Referring to FIG. 1A, the image forming apparatus 100 is an electrophotographic printer including image forming sections for forming yellow (Y), magenta (M), cyan (C), and black (K) images. Each image forming section 101 forms an image of a corresponding color. The image forming sections are aligned from upstream to downstream with respect to the direction of transportation of a recording medium 103. The image forming sections are configured in the same way; for simplicity's sake only the operation of a cyan image forming section will be described, it being understood that other image forming sections may work in a similar fashion.

Figure 1B:
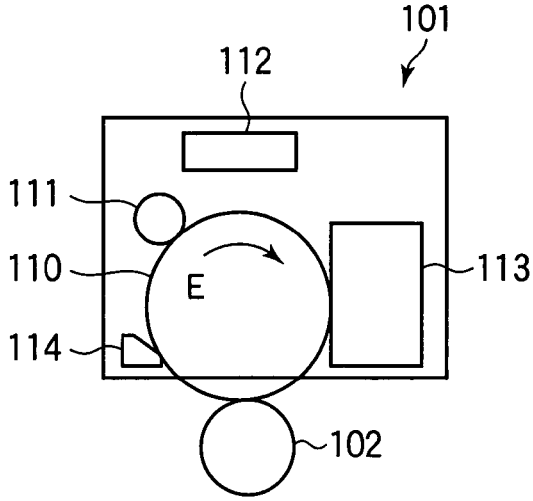
FIG. 1B illustrates a general configuration of a pertinent portion of an image forming section for cyan.

FIG. 1B illustrates a general configuration of a pertinent portion of an image forming section 101 for cyan. Referring to FIG. 1B, the image forming section 101 includes a photoconductive drum 110 that rotates in a direction shown by arrow E. A charging roller 111, an exposing unit 112, a developing unit 113, and a cleaning blade 114 are disposed from upstream to downstream with respect to rotation of the photoconductive drum 110, surrounding the photoconductive drum 110. The charging roller 111 uniformly charges the surface of the photoconductive drum 110. The exposing unit 112 illuminates the charged surface of the photoconductive drum 110 to form an electrostatic latent image. The developing unit 113 deposits toner of cyan to the electrostatic latent image to form a toner image. The cleaning blade 114 removes residual toner remaining on the photoconductive drum 110 after transfer of the toner image onto the recording medium 103. These rotating bodies in the respective image forming sections are driven in rotation by a drive source (not shown) via, for example, gears.

A transfer roller 102 is formed of an electrically conductive rubber material and is disposed to parallel to the photoconductive drum 110. A transfer belt (not shown) is sandwiched between the transfer roller 102 and the photoconductive drum 110 such that the transfer roller 102 is in a pressing relation with the photoconductive drum 110. A high voltage is applied to the transfer roller 102 for creating a potential difference across the surface of the photoconductive drum 110 and the surface of the transfer roller 102.

With the aforementioned configuration, toner images of the respective colors i.e., yellow (Y), magenta (M), cyan (C), and black (K) are sequentially transferred onto the recording medium 103 in registration. A fixing unit 50 includes a fixing roller 10 and a pressure roller 11. When the recording medium 103 having toner images of the respective colors thereon passes through a fixing pint defined between the fixing roller 10 and the pressure roller 11, the toner images are fused under heat and pressure. After fixing, the recording medium 103 is discharged by discharging rollers (not shown) onto a stacker (not shown).

Figure 2:
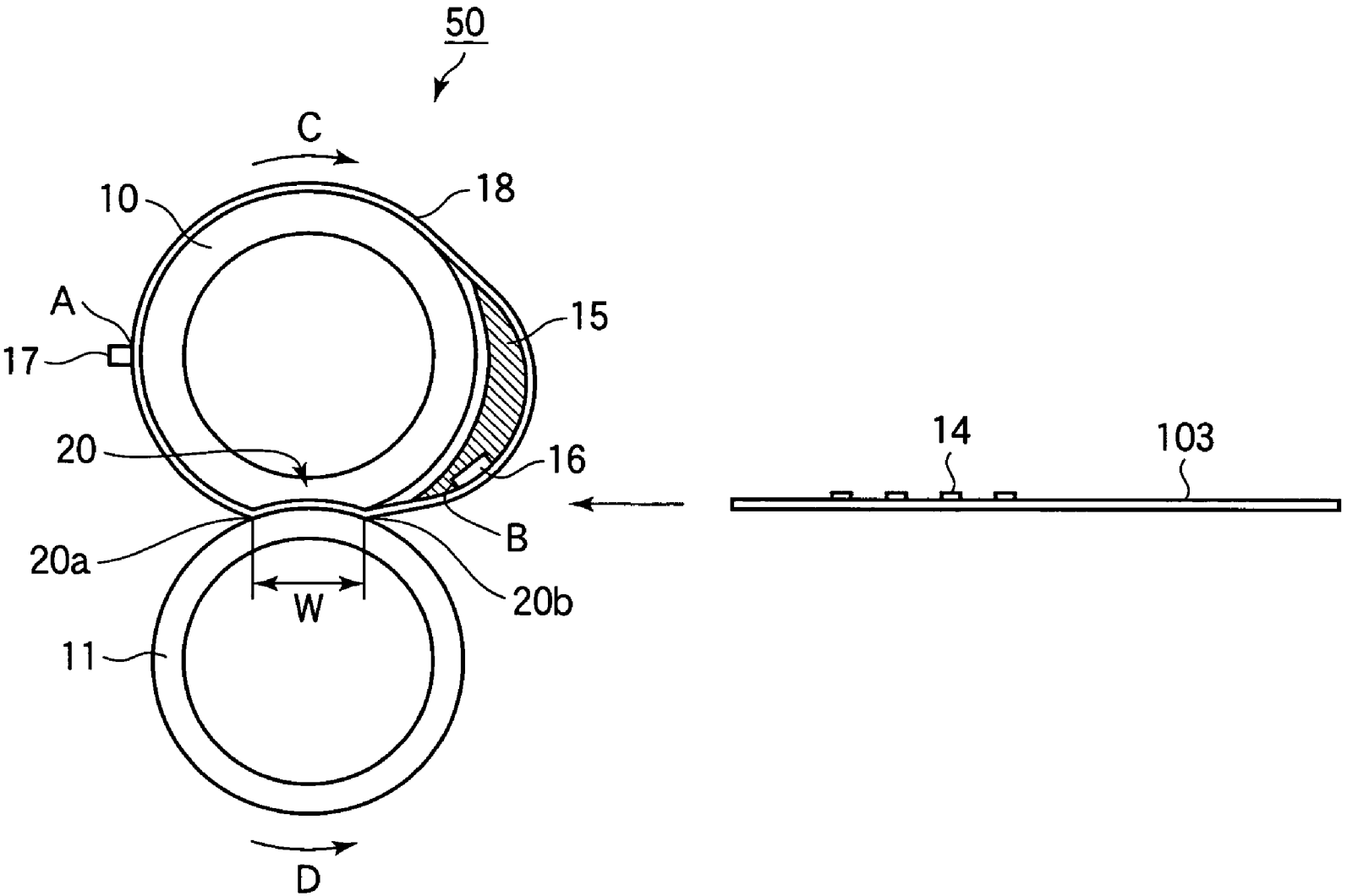
FIG. 2 illustrates the fixing apparatus of a first embodiment.

FIG. 2 illustrates the fixing unit 50 of the first embodiment.

Referring to FIG. 2, an endless fixing belt 18 is entrained about the fixing roller 10 and a support 15 that supports a heater 16 in the form of a sheet heating element. The support 15 and the heater element 16 press the fixing belt 18 from inside. The support 15 has a concave surface configured to the surface of the photoconductive drum 110 and a convex surface in contact with the inside surface of the fixing belt 18. The heater 16 is embedded in the support 15 and has a convex surface exposed on the convex surface of the support 15 such that the convex surface of the heater 16 is flush with the convex surface of the support 15.

The support 15 presses the fixing belt 18 with a force of about 2 kgf but not to disturb smooth sliding motion of the fixing belt 18 on the support 15. This force is provided by a spring (not shown) mounted on an appropriate location on the support 15. The pressure roller 11 and fixing roller 10 are disposed such that the fixing belt 18 is sandwiched under pressure between the fixing roller 10 and the pressure roller 11. A temperature sensor 17 may be disposed on the outer surface or inner surface of the fixing belt 18. Alternatively, the temperature sensor 17 may be disposed with a small gap between the fixing belt 18 and the temperature sensor 17. The temperature sensor 17 may take the form of a thermocouple, a thermistor, or a pyroelectric temperature sensor such as thermopile. The recording medium 103 carries a toner image 14 thereon.

Referring to FIG. 2, the heater 16 is at a location away from a nip 20 formed between the pressure roller 11 and the fixing belt 18.

Figure 3A:
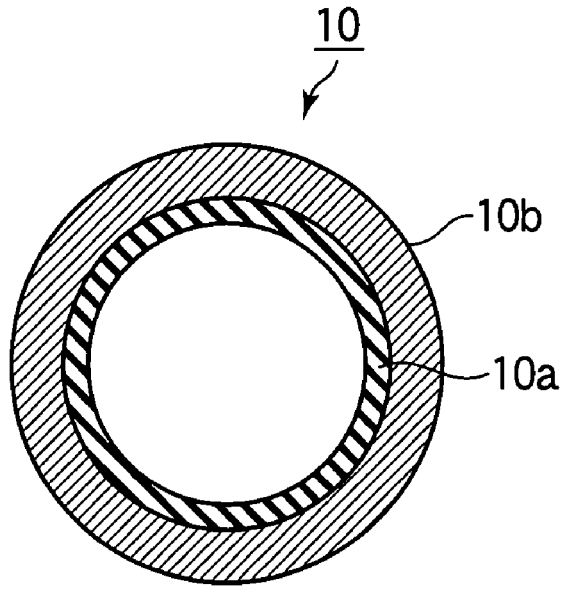
FIG. 3A is a cross-sectional view illustrating the interior of a fixing roller.
Figure 3B:
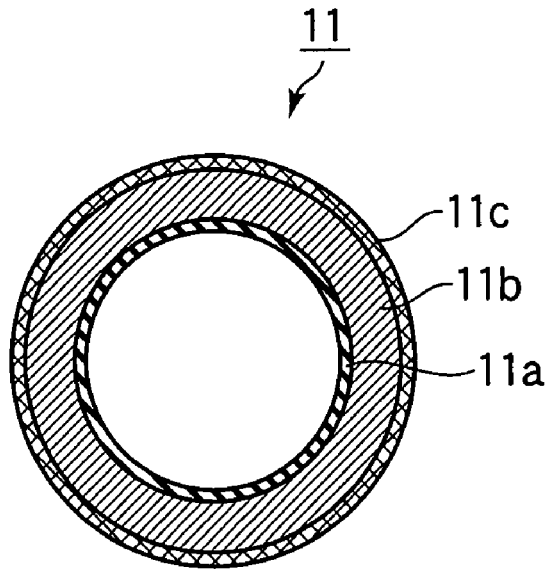
FIG. 3B is a cross-sectional view illustrating the interior of a pressure roller.

FIG. 3A is a cross-sectional view illustrating the interior of the fixing roller 10. FIG. 3B is a cross-sectional view illustrating the interior of the pressure roller 11.

Referring to FIG. 3A, the fixing roller 10 includes a core metal 10*a* and a resilient layer 10*b* that covers the core metal 10*a*. Referring to FIG. 3B, the pressure roller 11 includes a core metal 11*a* and a resilient layer 11*b* that covers the core metal 11*a*. A release layer 11*c* is formed on the resilient layer 11*b*. The resilient layers 10*b* and 11*b* are formed of a material such as silicone rubber; sponge-like silicone rubber that is a foamed resilient member; or a highly heat resistant rubber material such as fluorine-contained rubber. The core metals 10*a* and 11*a* may take the form of a metal pipe or a shaft formed of aluminum, iron, or stainless steel. The core metals 10 and 10*b* may take the form of a metal pipe.

Figure 4A:
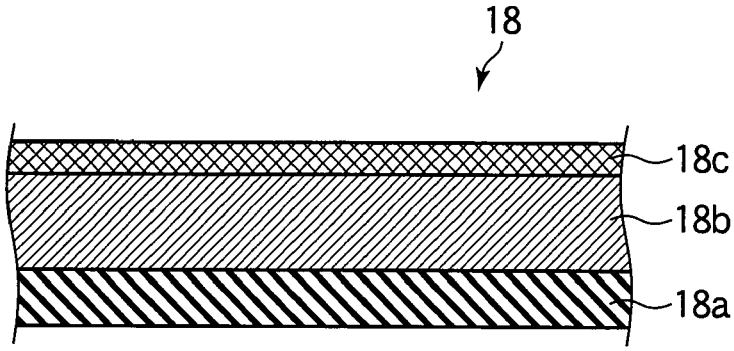
FIG. 4A and FIG. 4B are cross-sectional views of the stacked structure of a fixing belt.
Figure 4B:
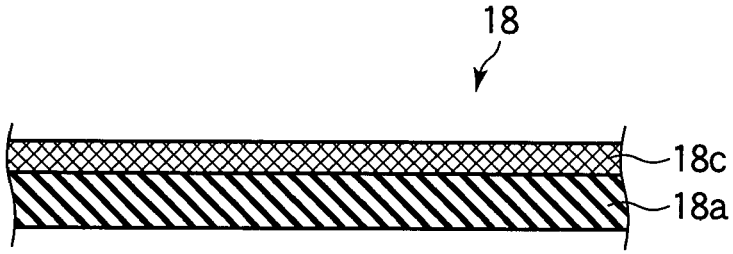

FIG. 4A and FIG. 4B are cross-sectional views of the stacked structure of the fixing belt 18.

Referring to FIG. 4A, the fixing belt 18 includes a thin base 18*a* on which a thin resilient layer 18*b* of silicone rubber or fluorine resin is formed. A release layer 18*c* may be formed on the resilient layer 18*b*. Alternatively, the release layer 18*c* may be formed on the thin base 18*a* as shown in FIG. 4B. The fixing belt 18 is entrained about the fixing roller 10 and the support 15 such that the release layer 18*c* is the outer surface of the fixing belt 18.

If the base 18*a* is formed of nickel, polyimide, or stainless steel, the thickness of the base 18*a* is preferably in the range of 30 to 150 μm for both mechanical strength and flexibility. If the resilient layer 18*b* is formed of silicone rubber, the thickness of the resilient layer 18*b* is preferably in the range of 50 to 300 μm for low hardness and high heat transfer. If the resilient layer 18*b* is formed of fluoroplastic, the thickness of the resilient layer 18*b* is preferably in the range of 10 to 50 μm for low wear and high heat transfer.

Just as the release layer 11*c* of the pressure roller 11, the release layer 18*c* may be formed of a resin having a high heat resistance and a low surface free energy, for example, polytetrafluoroethylene (PTFE), perfluoroalkoxy alkane (PFA), perfluoroethylene-propen copolymer (FEP). The release layer 18*c* formed of one of these materials should have a thickness in the range of 10 to 50 μm. The support 15 is formed of a highly heat resistant resin such as polyphenylenesulfide (PPS), polyether ether ketone (PEEK), or liquid crystal polymer (LCP). In order to prevent deformation and damage due to heat, a material such as glass fiber or glass beads may be added.

The heater 16 has a convex surface in contact with the inside of the fixing belt 18, and may take the form of a resistive heater element such as a stainless steel film or a nichrome wire inserted into a polyimide film or a mica film. The heater 16 may also be a ceramic heater or a stainless steel heater. A stainless steel heater is preferable for power capacity, durability, and machinability.

Figure 5A:
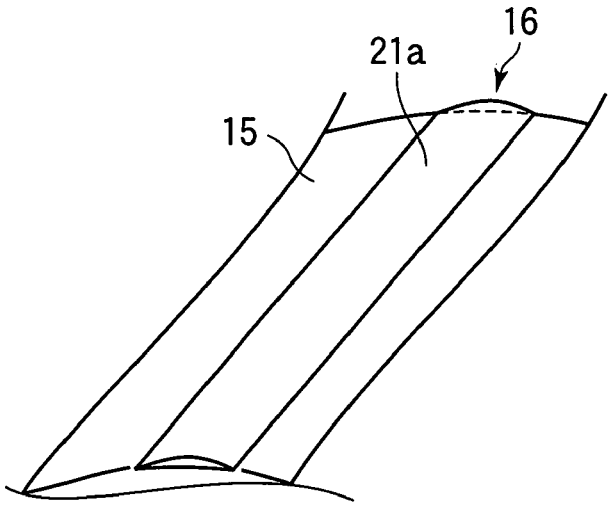
FIG. 5A is a perspective view illustrating an example of a heater implemented by a stainless steel heater.
Figure 5B:
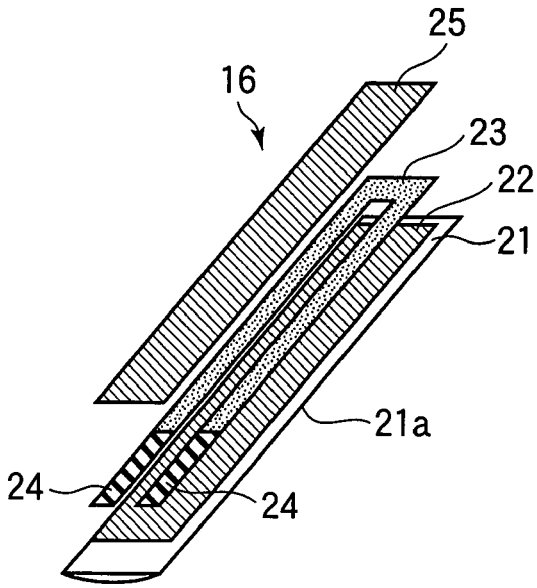
FIG. 5B is an exploded perspective view of the heater.

FIG. 5A is a perspective view illustrating an example of the heater 16 implemented by a stainless steel heater. FIG. 5B is an exploded perspective view of the heater 16.

Referring to FIG. 5A, the heater 16 is in an arcuate shape and includes the base 21 having a convex surface 21*a* in contact with the inner surface of the fixing belt 18. The convex surface 21*a* is flush with the convex surface of the support 15. An electrically insulating layer 22, a resistive heater element 23 having electrodes 24, and a protection layer 25 are stacked in this order. The base 21 is formed of stainless steel (e.g., SUS430). The electrically insulating layer 22 is a thin film of glass. The resistive heater element 23 is formed by applying a paste-like powder on the electrically insulating layer 22 by screen printing, the paste-like powder being formed of an alloy of nickel and chrome or an alloy of silver and palladium. The electrode 24 of the heater element 23 is formed of a metal having a low resistance and chemical stability or a metal such as tungsten having high melting point. The protection layer 25 is formed of glass or a typical fluorine resin such as polytetrafluoroethylene (PTFE), perfluoroalkoxy alkane (PFA), or perfluoroethylene-propen copolymer (FEP).

The binding resins for the toner 14 may include polystyrene, styrene/propylene copolymer, styrene/vinyl naftalene copolymer, styrene/methyl acrylate copolymer, polyester copolymer, polyurethane copolymer, epoxy copolymer, aliphatic resin or aliphatic hydrocarbonate resin, and aromatic hydrocarbonate resin. The toner 14 may be formed of one of these materials or a mixture of more than one of these materials. A wax may be added to the toner 14 in order to prevent offset during fixing, i.e., some of the fused toner remains adhering to the fixing belt 18 and is transferred onto the recording medium 103. Waxes for this purpose include polypropylene wax, propylene wax, carnauba wax, and other ester waxes.

Referring to FIG. 2, the fixing roller 10 rotates in a direction shown by arrow C, and the pressure roller 11 rotates in a direction shown by arrow D. The temperature sensor 17 is positioned at point A downstream of the nip 20. The heater 16 is positioned at point B upstream of the nip 20. In other words, the temperature sensor 17 is located upstream of the heater 16 with respect to rotation of the fixing roller 10. If the circumferential speed V of the fixing belt 18 is high, there will be no significant heat loss from the fixing belt 18 to the environment. If the circumferential speed V is fairly low, there may be a significant heat loss from the fixing belt 18 to the environment. In any case, the temperature sensor 17 should be disposed downstream of the nip 20 with respect to rotation of the fixing roller 10 and upstream of the heater 16.

It is assumed that the dimension of the temperature sensor 17 in the direction of travel of the fixing belt is negligibly small compared to the dimension of the heater 16 in the direction of travel of the fixing belt 18. In other words, the area of the temperature sensor 17 in contact with the fixing belt 18 is much smaller than the area of the heater 16 in contact with the fixing belt 18. The temperature sensor detects the temperature at point A in FIG. 2.

The operation of the fixing unit 50 of the aforementioned configuration will be described with reference to FIG. 2. When a drive means (not shown) drives the fixing roller 10 and pressure roller 11 to rotate, the fixing belt 18 runs in the C direction, sliding on the support 15. As the fixing belt 18 rotates, the fixing belt 18 in contact with the heater 16 is heated. The temperature sensor 17 detects the temperature of the fixing belt 18 and a controller (not shown) controls the electric power supplied to the heater 16, thereby maintaining the surface of the fixing belt 18 to a predetermined target temperature. The electric power supplied to the heater 16 is controlled by changing the duty cycle of a voltage pulse applied to the heater, i.e., PWM control.

The pressure roller 11 and the fixing roller 10 holds the fixing belt 18 in sandwiched relation such that the nip 20 is formed between the fixing roller 10 and the pressure roller 11. The nip 20 has a width of W as shown in FIG. 2. The recording medium 103 carrying the toner 14 thereon passes through the nip 20 so that the toner 14 is fixed under heat and pressure.

Table 1 lists the results of printing for various values of target temperature T and time Ta during which a portion of the belt 18 travels from point A to point B in the C direction and time Ta during which the portion of the belt 18 travels from point B to point A in the C direction when the temperature sensor 17 is downstream of the heater 16 and upstream of the nip 20.

The time Ta during which a portion of the belt 18 travels from point A to point B is given by $Ta=(R_B-R_A)/V$ where $R_B$ is a distance from point 20*a* (downstream end of the nip 20) through the temperature sensor 17 to point B (downstream end of the heater 16), $R_A$ is a distance from point 20*a* to point A, and V is the circumferential speed of the fixing belt 18. For $R_B>R_A$, Ta is positive. For $R_B<R_A$, Ta is negative. The controller controls the electric power supplied to the heater 16 such that a surface temperature Ts of the belt 18 is equal to the target temperature T.

The printing was performed with the following conditions.

Fixing Belt 18:
- Inner diameter: 45 mm
- Base 18*a*: polyimide (90 μm thick)
- Resilient layer 118*b*: silicone rubber (200 μm thick)
- Release layer 18*c*: PFA (30 μm thick)

Fixing Roller 10
- diameter: 30 mm
- Resilient layer 101: silicone sponge (8 mm thick) 35 on the ASKER C scale Pressure Roller 11
- Diameter: 30 mm
- Resilient layer 11*b*: silicone sponge (8 mm thick) 35 on the ASKER C scale
- Release layer 11*c*: PFA (30 μm thick)
- Pressing force: 12 kgf Heater 16
- Stainless steel heater: 20 mm width, 850 Watts
- Pressing load: 1.0 kgf
- Toner 14: polystyrene toner, yellow, magenta, cyan, 15 weight parts of wax Recording Medium 103
- 64 kg/m2, A4 size, portrait orientation
- Amount of transferred toner: 1.5±0.1 g/sheet of medium
- Paper feeding speed: 200 mm/sec Printing of 10 pages was performed with a spacing of 50 mm between adjacent sheets of recording medium 103. Symbol "○" indicates that no poor fixing occurred. Symbol "Δ" indicates that hot-offset occurred due to melted toner. Symbol "X" indicates that cold-offset occurred due to insufficiently melted toner.

TABLE 1

| Target | Time, Ta (sec) | | | | | | |
|---|---|---|---|---|---|---|---|
| temp. T° C. | −0.2 | −0.1 | −0.05 | 0 | 0.05 | 0.1 | 0.2 |
| 150 | X | X | X | ○ | ○ | ○ | ○ |
| 160 | X | X | X | ○ | ○ | ○ | ○ |
| 170 | X | X | X | ○ | ○ | ○ | ○ |
| 180 | Δ | Δ | Δ | ○ | ○ | ○ | ○ |
| 190 | Δ | Δ | Δ | ○ | ○ | ○ | ○ |

The results listed in Table 1 reveals that poor fixing does not occur for target temperatures T in the range of 150 to 190° C. and times Ta of positive values in Table 1. In other words, poor fixing does not occur for target temperatures T in the range of 150 to 190° C., the temperature sensor being located downstream of the nip with respect to rotation of the fixing belt and upstream of the heater with respect to rotation of the fixing belt. In other words, the temperature sensor 17 should be disposed within the area of the fixing belt 18 in contact with the heater 16 or upstream of the heater 16 with respect rotation of the fixing belt 18 (i.e., Ta is positive in Table 1). The results also reveal that poor fixing occurs if the temperature sensor 17 is disposed downstream of the heater 16 and upstream of the nip (i.e., Ta is negative in Table 1).

The results may have been caused by the following facts.

Assume that the temperature sensor 17 is disposed downstream of the heater 16 and upstream of the nip 20. The temperature sensor 17 detects the temperature of the fixing belt 18 before the fixing belt 18 passes through the nip. When the fixing belt 18 passes through the nip, the heat in the fixing belt 18 is lost to the recording medium 103. This implies that the actual temperature of the fixing belt 18 during fixing is lower than that detected by the temperature sensor 17. This causes poor temperature control. If the value of the time Ta is positive in Table 1, i.e., if the heater 16 is upstream of the nip 20 and the temperature sensor 17 is disposed immediately downstream of the nip 20, the temperature of the fixing belt 18 detected by the temperature sensor 17 is substantially the same as that at the nip 20.

For color printing, toner images of the respective colors are transferred onto the recording medium 103 one over the other in registration. Heat must be efficiently supplied to the uneven surface of the stacked toner images. One way of efficiently supplying heat to the toner image is to provide a resilient layer on the fixing belt 18. The resilient layer deforms to conform to the uneven surface of the stacked toner images, thereby facilitating uniform heat transfer to every part of the toner images. In the first embodiment, heat supplied from the heater to the inner surface of the fixing belt 18 is transferred from the inner surface to the outer surface before the belt enters the nip 20, so that the heat may be efficiently added to the toner images on the recording medium 103. Additionally, the resiliency of the fixing roller 10 is effective in making the nip larger.

Because a large portion of the fixing roller 10 is in contact with the fixing belt 18, the fixing roller 10 stores some heat. The fixing belt 18 slides on the fixing roller 10 while a large portion of the fixing belt 18 wrapping around the fixing roller 10. This is advantageous in that the amount of heat that the fixing belt 18 loses to the environment may be minimized and in that the fixing belt may be heated by the heater 16 to a desired temperature relatively easily in the next cycle. The resilient layer of the fixing roller 10 is formed of a foamed resilient material, which is advantageous in that the resilient layer may have a large heat capacity, effective in minimizing temperature fluctuation.

Second Embodiment

Figure 6:
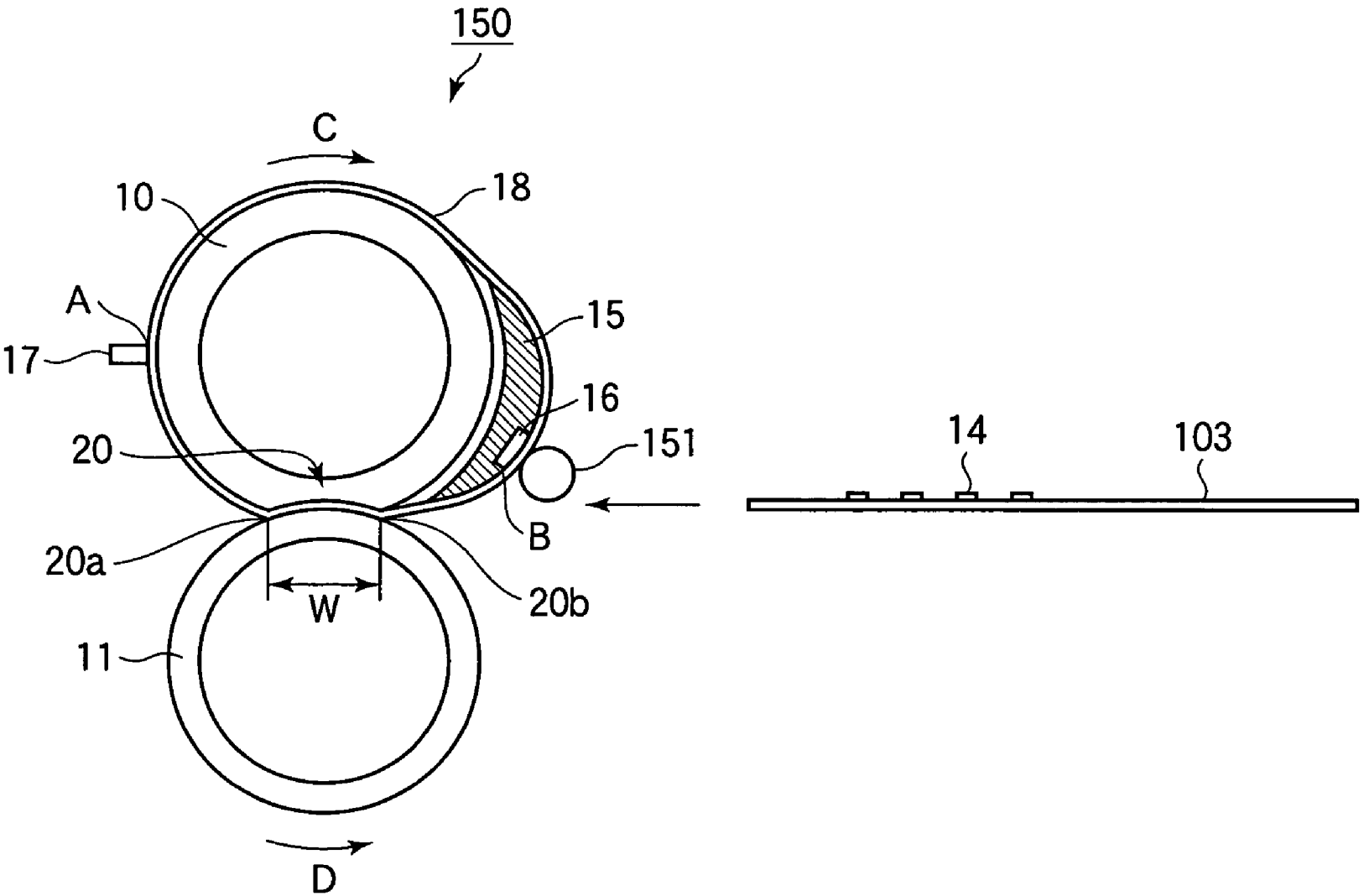
FIG. 6 illustrates a pertinent portion of a fixing unit of a second embodiment.

FIG. 6 illustrates a pertinent portion of a fixing unit 150.

The fixing unit 150 differs from the fixing unit 50 in that a release agent applying member 151 is employed. Elements similar to those in the first embodiment have been given the same reference numerals and the description thereof is omitted.

Referring to FIG. 6, the fixing belt 18 is entrained about a fixing roller 10 and a support 15 that supports a heater 16 in the form of a sheet heating element. The heater 16 and the support 15 press the fixing belt 18 from inside. The support 15 has a concave surface configured to the surface of the photoconductive drum 110 and a convex surface in contact with the inside surface of the fixing belt 18. The heater 16 is embedded in the support 15 and has a convex surface exposed on the convex surface of the support 15 such that the convex surface of the heater 16 is a part of the convex surface of the support 15. In other words, the convex surface of the heater 16 is flush with the convex surface of the support 15.

The release agent applying member 151 is disposed such that the fixing belt 18 is sandwiched between the heater 16 and the release agent applying member 151. A release agent serves to facilitate removal of the recording medium 103 from the fixing belt 18 after fixing. The release agent should have good heat resistance, toner releasability, and chemical stability, and may include dimethylsilicone oil, denatured dimethylsilicone oil, and fluorinated oil. The release agent applying member 151 may be a roller in which a release agent may be impregnated, and is caused to roll on the fixing belt 18. Alternatively, the release agent applying member 151 may take the form of a roller having a porous film from which the release agent exudes. Still alternatively, the release agent applying member 151 may be a felt in which a release agent may be impregnated.

In order for the fixing belt 18 to slide on the support 15 without difficulty, a total amount of pressing force produced by the support 15 and the release agent applying member 151 against the fixing belt 18 should be a maximum of 2 kgf. The pressure roller 11 presses the fixing roller 10 with the fixing belt 18 sandwiched between the pressure roller 11 and the fixing roller 10.

The structure and arrangement of a temperature sensor 17, a sheet heating element 16, a fixing roller 10, a pressure roller 11, a support 15, and a fixing belt 18, and toner 14 are substantially the same as those of the first embodiment and the description thereof is omitted.

The fixing belt 18 is driven by the fixing roller 10 and pressure roller 11, which are driven in rotation by a drive means (not shown), such that the fixing belt 18 slides on the support 15 in a direction shown by arrow C. Electric power is supplied to the heater 16, which in turn heats the fixing belt 18 as the fixing belt 18 slides on the heater 16. The release agent applying member 151 presses the fixing belt 18 against the heater 16 while also applying the release agent to the outer surface of the fixing belt 18. A temperature sensor 17 detects the temperature of the fixing belt 18, and a controller (not shown) controls the supply of electric power to the heater 16 in accordance with the detected temperature, thereby maintaining the surface temperature Ts to a predetermined value.

The pressure roller 11 presses the fixing belt 18 against the fixing roller 10 to form a nip 20 between the fixing belt 18 and the pressure roller 11. A recording medium 103 carries toner 14 thereon, and is fed into the nip 20, so that the toner 14 is fixed into the recording medium 103 under heat and pressure.

For the fixing unit 150, printing was performed to evaluate printing performance with a target temperature T=170° C. and time Ta=0.05.

Printing was performed under the following two conditions. The remaining conditions including the medium feeding orientation, the amount of toner 14 transferred per page, and the speed at which the medium 103 is fed are the same as those in the first embodiment. The fixing belt 18, fixing roller 10, pressure roller 11, heater 16, toner 14, and recording medium 103 are the same as those in the first embodiment. The release agent applying member 151 is a roller having a diameter of 12 mm covered with a felt material (3 mm thick) in which dimethylsilicone oil has been impregnated.

When the release agent applying member 151 is not used, the temperature of the heater 16 was a maximum of 350° C. When the release agent applying member 151 is used, the temperature of the heater was a maximum of 300° C. This is considered due to the fact that the release agent applying member 151 presses the fixing belt 18 against the heater 16 ensuring intimate contact between the fixing belt 18 and the heater 16 to reduce the heat resistance between the fixing belt 18 and the heater 16. Thus, the amount of heat generated by the heater 16 may be smaller.

The fixing unit of the second embodiment provides advantages similar to those of the first embodiment. In addition, the second embodiment improves the heat utilization efficiency and toner releasability.

A sheet heating member of the invention extends over an area across an endless belt, and is in contact with the endless belt. This configuration allows the belt temperature to rise rapidly when the belt is heated. Further, because a pressure member contacts the endless belt at the nip and not the heater, the heat generated by the heating member is not directly lost to the pressure member, preventing rapid temperature decrease. This ensures reliable temperature control.

The first and second embodiments have been described in terms of an electrophotographic printer that uses toner of a plurality of colors. The present invention is not limited to the configuration of the first and second embodiments, and may be applicable to image forming apparatuses including a copying machine, a facsimile machine, and a multi function printer.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A fixing apparatus comprising:

an endless belt;

a first pressure member, comprising a roller, with a resilient outer layer, positioned on an inside of the endless belt;

a second pressure member positioned on an outside of the endless belt, said second pressure member cooperating with said first pressure member to hold said endless belt between said first pressure member and said second pressure member in sandwiched relation such that a nip is formed between said endless belt and said second pressure member;

a heat generating body including a surface in contact with said endless belt from the inside of said endless belt, the surface being located outside of the nip, and heat is generated in the heat generating body and transferred to the endless belt through the surface, the heat generating body being disposed upstream of the nip with respect to a rotation of the endless belt, and the endless belt being wrapped about, so as to contact, the first pressure member downstream of the nip with respect to the rotation of the endless belt; and a supporting member disposed on the inside of said endless belt, said supporting member supporting said heat generating body and including a surface that cooperates with said first pressure member such that said endless belt is entrained about said first pressure member and said supporting member and slides on the surface.

2. The fixing apparatus according to claim 1, wherein said endless belt includes a resilient layer.

3. The fixing apparatus according to claim 1, wherein the resilient outer layer is formed of a foamed resilient material.

4. The fixing apparatus according to claim 1, wherein said second pressure member is a roller including a resilient layer.

5. The fixing apparatus according to claim 4, wherein said resilient layer is formed of a foamed resilient material.

6. The fixing apparatus according to claim 1, further comprising a temperature sensor that detects a temperature of said endless belt, the temperature sensor being located downstream of the nip with respect to rotation of said endless belt and upstream of said heat generating body with respect to rotation of said endless belt, and in an area in which said endless belt is in contact with said first pressure member after said endless belt has passed through the nip.

7. The fixing apparatus according to claim 1, further comprising a release agent applying member disposed such that said endless belt is sandwiched between said heat generating body and the release agent applying member, the release agent applying member applying a release agent to said endless belt for facilitating smooth removal of a recording medium from said endless belt after fixing.

8. The fixing apparatus according to claim 7, wherein said release agent applying member includes a roller that applies the release agent to said endless belt, the roller contacting said endless belt under pressure.

9. The fixing apparatus according to claim 1, wherein said heat generating body is a stainless steel heater.

10. An image forming apparatus incorporating said fixing apparatus according to claim l, comprising:

an image forming section that forms a toner image; and a transfer section that transfers the toner image onto a recording medium.

11. The fixing apparatus according to claim 1, wherein the heat generating body is a sheet heating element, the surface of which lies substantially in a same plane in which an inner surface of the endless belt lies.

12. The fixing apparatus according to claim 11, wherein the sheet heating element has a convex surface in contact with the inner surface of the endless belt.

* * * * *